US006237372B1

(12) United States Patent
Puigventos

(10) Patent No.: US 6,237,372 B1
(45) Date of Patent: May 29, 2001

(54) DEVICE FOR THE ATTACHMENT OF FEEDERS IN CIRCULAR MACHINES FOR KNITTED FABRICS

(75) Inventor: Antonio Puigventos, Badalona (ES)

(73) Assignee: Jumberca, S.A., Badalona Barcelona (ES)

( * ) Notice: Subject to any disclaimer, the term of this patent is extended or adjusted under 35 U.S.C. 154(b) by 0 days.

(21) Appl. No.: 09/572,533

(22) Filed: May 17, 2000

(30) Foreign Application Priority Data

May 28, 1999 (ES) ..... 99 011 56

(51) Int. Cl.[7] ..... D04B 15/58
(52) U.S. Cl. ..... 66/133
(58) Field of Search ..... 66/125 R, 133, 66/134, 136, 137, 138, 141, 17, 8, 13, 14

(56) References Cited

U.S. PATENT DOCUMENTS 2,399,729 * 5/1946 Fregeolle ..... 66/133
3,975,926 * 8/1976 Tenconi ..... 66/133
5,056,339 * 10/1991 Lonati ..... 66/134
5,218,845 * 6/1993 Wang ..... 66/139
5,524,459 * 6/1996 Beconcini ..... 66/136
6,109,069 * 8/2000 Sangiacomo ..... 66/133

* cited by examiner

*Primary Examiner*—Danny Worrell
(74) *Attorney, Agent, or Firm*—Nath & Associates PLL; Gary M. Nath; Marvin C. Berkowitz

(57) ABSTRACT

Device for the attachment of feeders in circular machines for knitted fabrics, according to which, in the upper and outer pail of the feeder body, there is arranged, between the body and the fixed part of the machine, a joint with shaft tangent to a circle that is perpendicular to the central shaft of the machine. Thus, by means of a turn, it is possible to move the feeder between a working position situated toward the interior of the machine and a position toward the exterior of the machine in which the feeder is raised outside the working area.

12 Claims, 7 Drawing Sheets

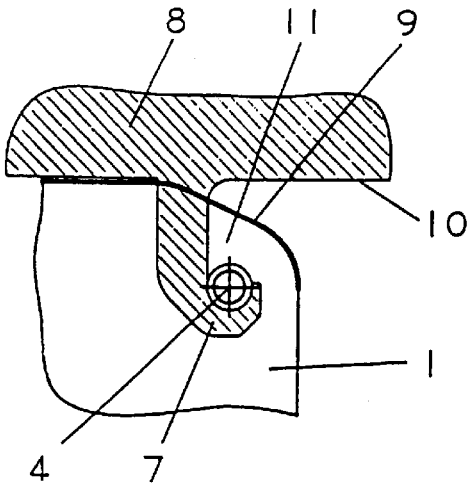
Fig.7.1
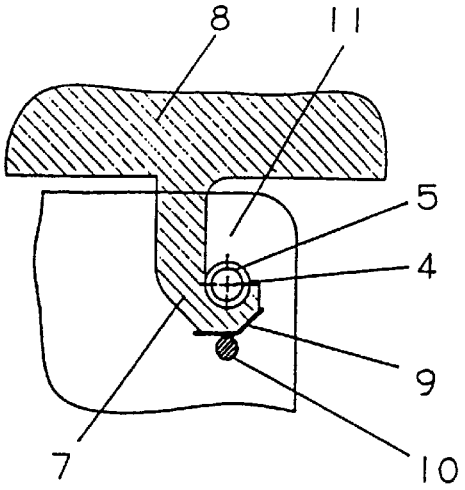
Fig.7.2
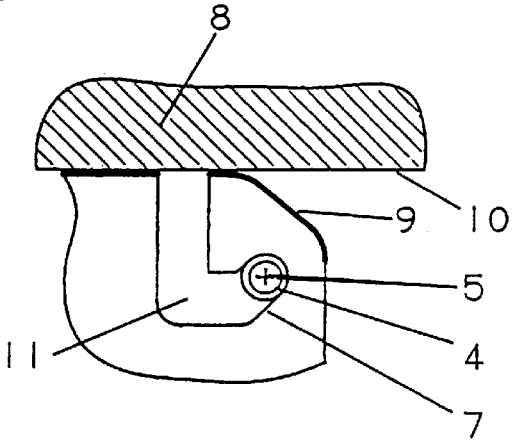
Fig.7.3
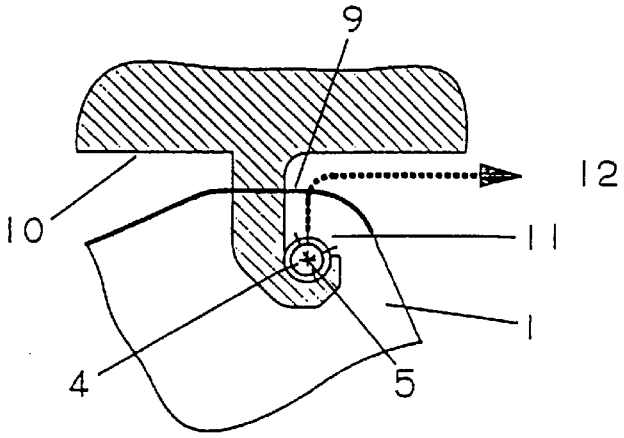
Fig.8

DEVICE FOR THE ATTACHMENT OF FEEDERS IN CIRCULAR MACHINES FOR KNITTED FABRICS

FIELD OF THE INVENTION

This invention relates to a device for improving the attachment of feeders in a circular machine used in manufacturing striped knitted fabrics.

DESCRIPTION OF THE RELATED ART

The systems employed in the past are highly varied, depending on the shape of the feeder and, according to the mechanism on which they are attached, either the structure of the machine or the cross section of the body. But, in almost all known systems, a guide system for the feeder is used, as well as a locking device that uses a screw, which then requires the use of some tool for the purpose of assembling or disassembling the feeder.

Another inconvenience inherent in the known systems is represented by the fact that, once the feeder is released from the machine, it must be moved away from it since it is no longer supported on any fixed part of the machine. Because of this, the threads must usually be released from the feeder, which requires, once again, lining up all the feeders that had been removed from the machine, all of which represents a considerable loss of time.

These inconveniences are further aggravated especially in machines that have mechanisms in the posterior part of the feeders; this may presumably be a very great inconvenience in machines that require handling or manual preparation by the operator in these areas. This happens in double-lined machines where a needle plate is arranged with manually programmable levers.

SUMMARY OF THE INVENTION

The purpose of this invention is to eliminate all of these inconveniences; the feeder can thus be fixed and unlocked without the use of tools. In addition, the system makes it possible to raise the feeder up to a position where the operator can obtain access to the interior part of the machine without either having to cut the threads, or to move the feeder away from the machine.

According to the system involved in the invention, a joint is placed between the upper and outer part of the feeder and the fixed part of the machine so that the feeder may be turned between a working position, situated toward the interior of the machine, and a position situated toward the exterior of the machine, outside the working area, thus leaving the interior part of the machine accessible.

In this way, one gets a very advantageous system for applique machines because of the savings in time and work that it provides in the handling operations that must be performed in the interior mechanisms of the pertinent machine, thus resulting in this preferred applique system for use on machines for which it is intended.

BRIEF DESCRIPTION OF THE DRAWINGS

FIGS. 7.1, 7.2 and 7.3 show three examples of the joint and the closing levers.

FIG. 8 shows the path for the extraction of the feeder from the machine.

FIGS. 1 and 2 show known systems for the attachment of feeders (1); the guide systems (2) and the attaching screws (3) are shown here.

DETAILED DESCRIPTION OF THE INVENTION

Figure 1:
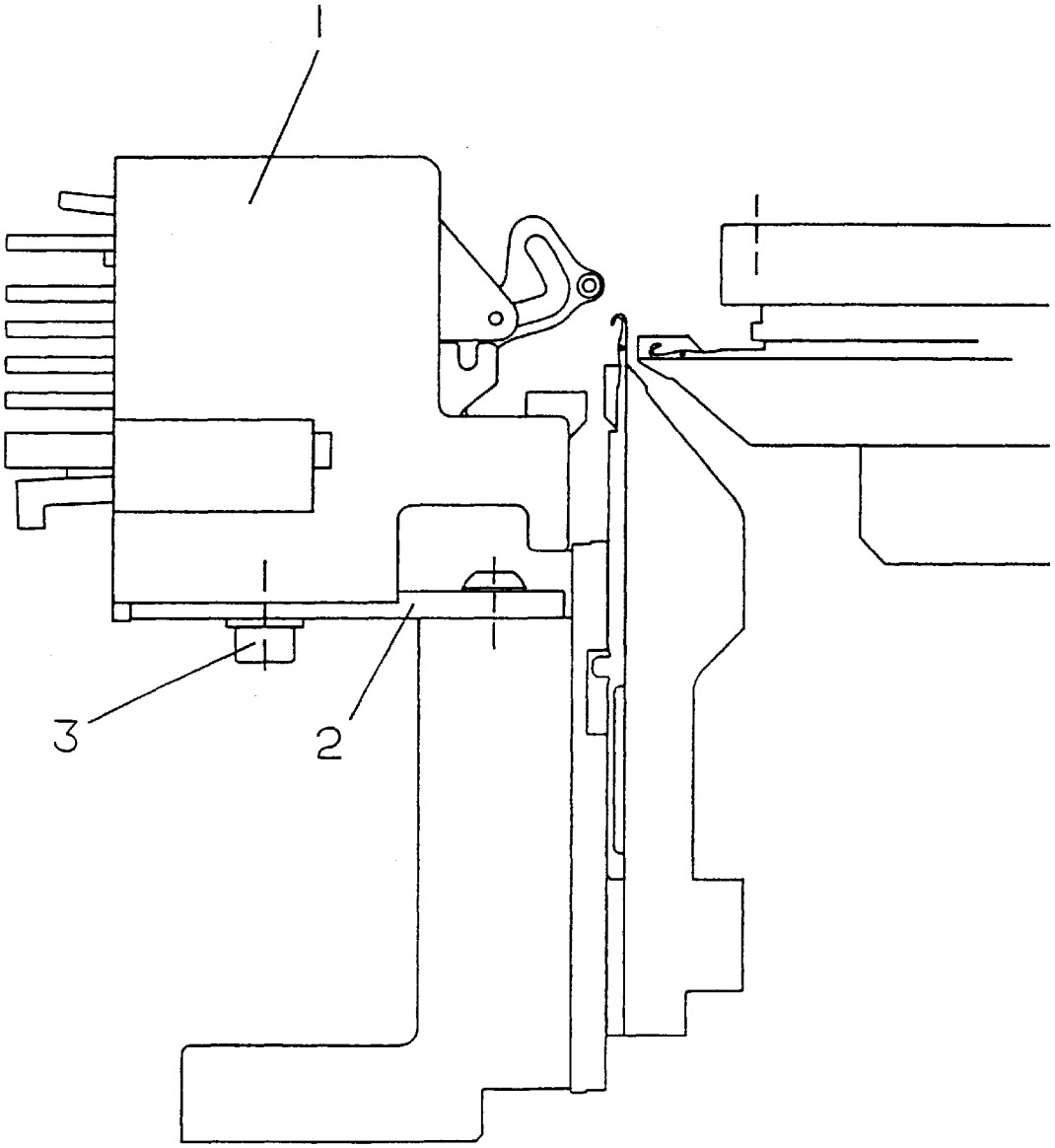
Fig. 1 (PRIOR ART)
FIGS. 1 and 2 show some known systems for the attachment of feeders.
Figure 2:
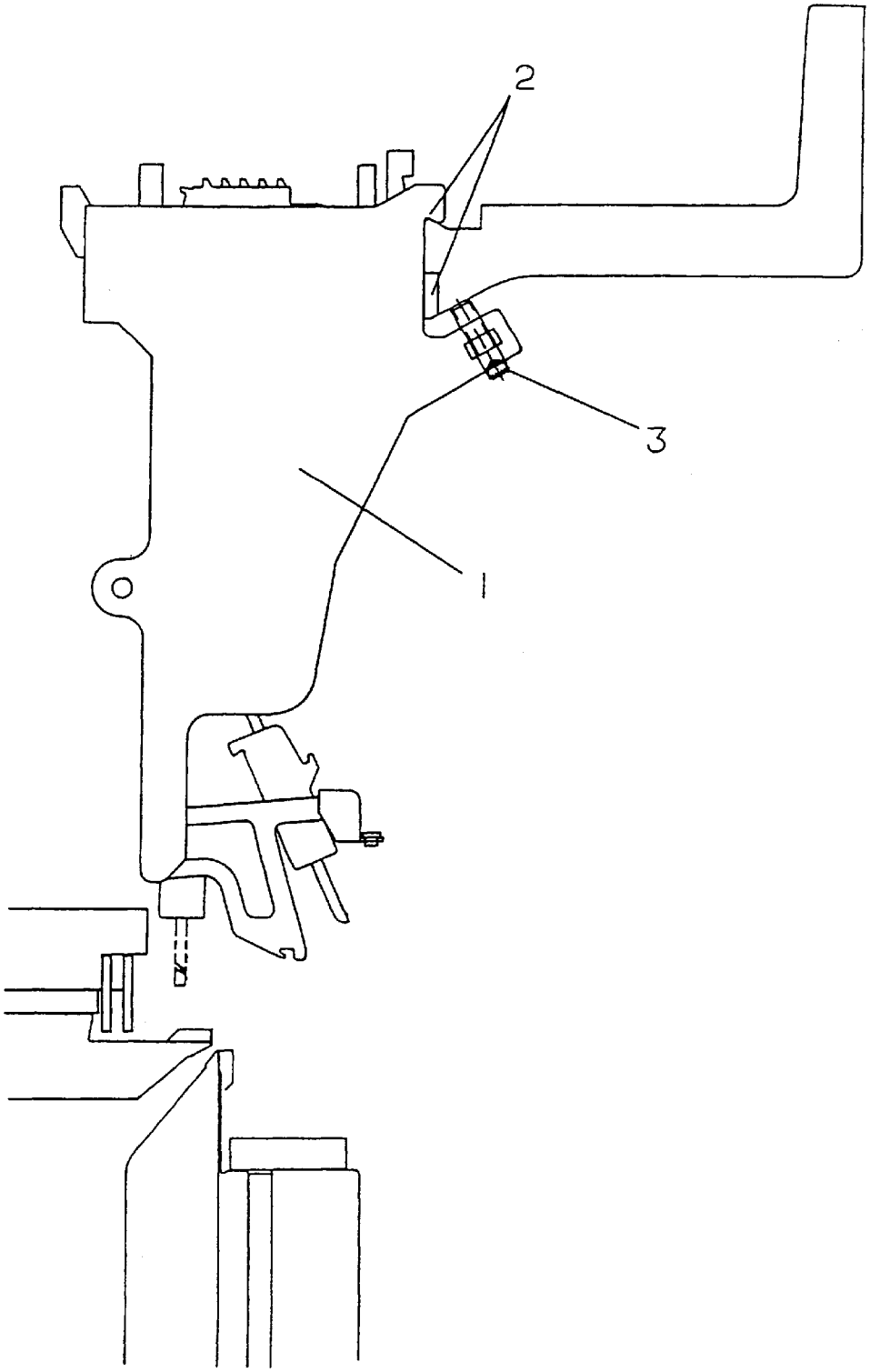
Fig. 2 (PRIOR ART)
Figure 3:
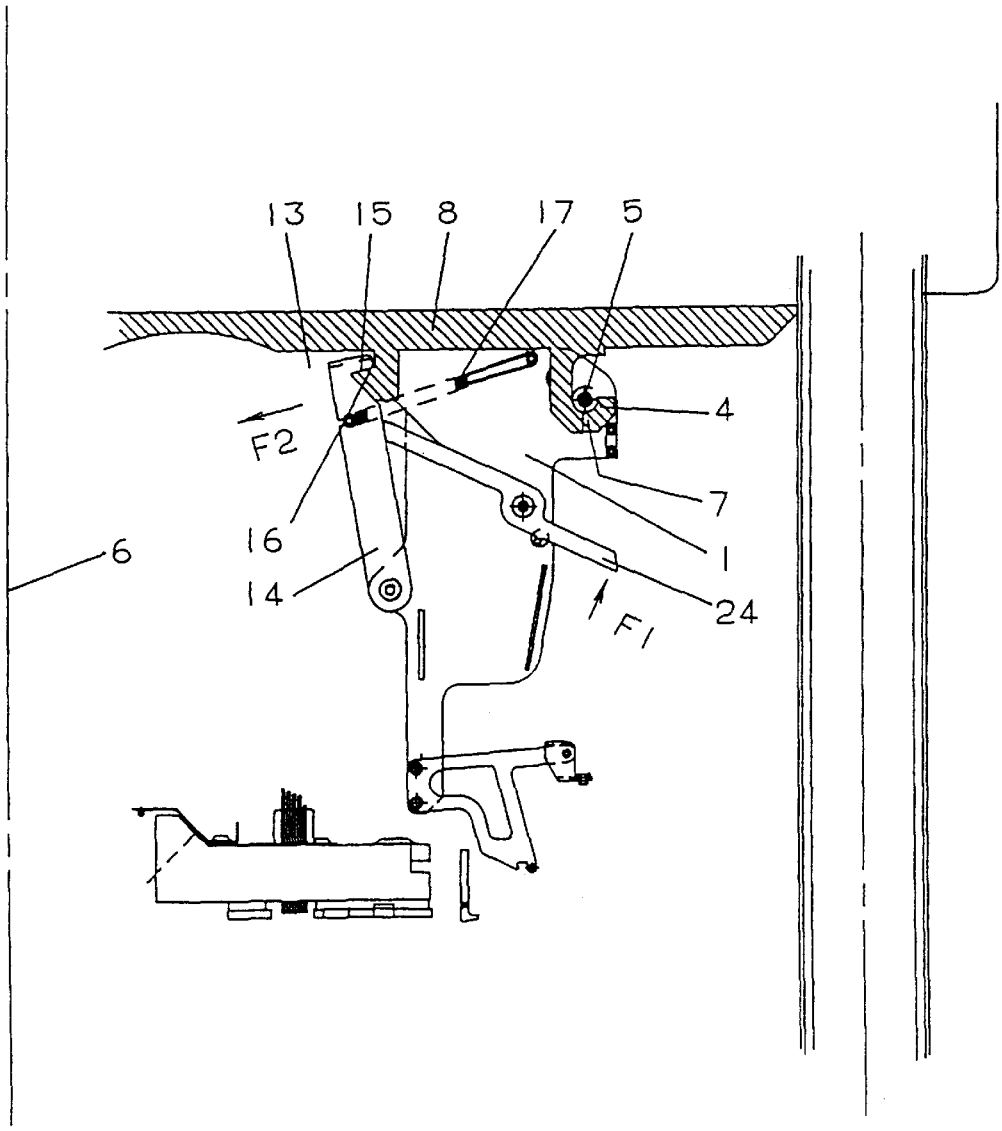
FIG. 3 shows the diagram of a new system for the attachment of the feeder.

In FIG. 3 one can see a basic diagram, illustrating the fixation system for the feeders, which is the object of this invention; the feature is non-restrictive since it is obvious that the fact that different structural shapes are used does not modify the object of the invention.

In this FIG. 3, we observe the body of feeder (1) where a lug or shaft of a joint (4) is arranged in the upper and outer part of the machine.

Figure 4:
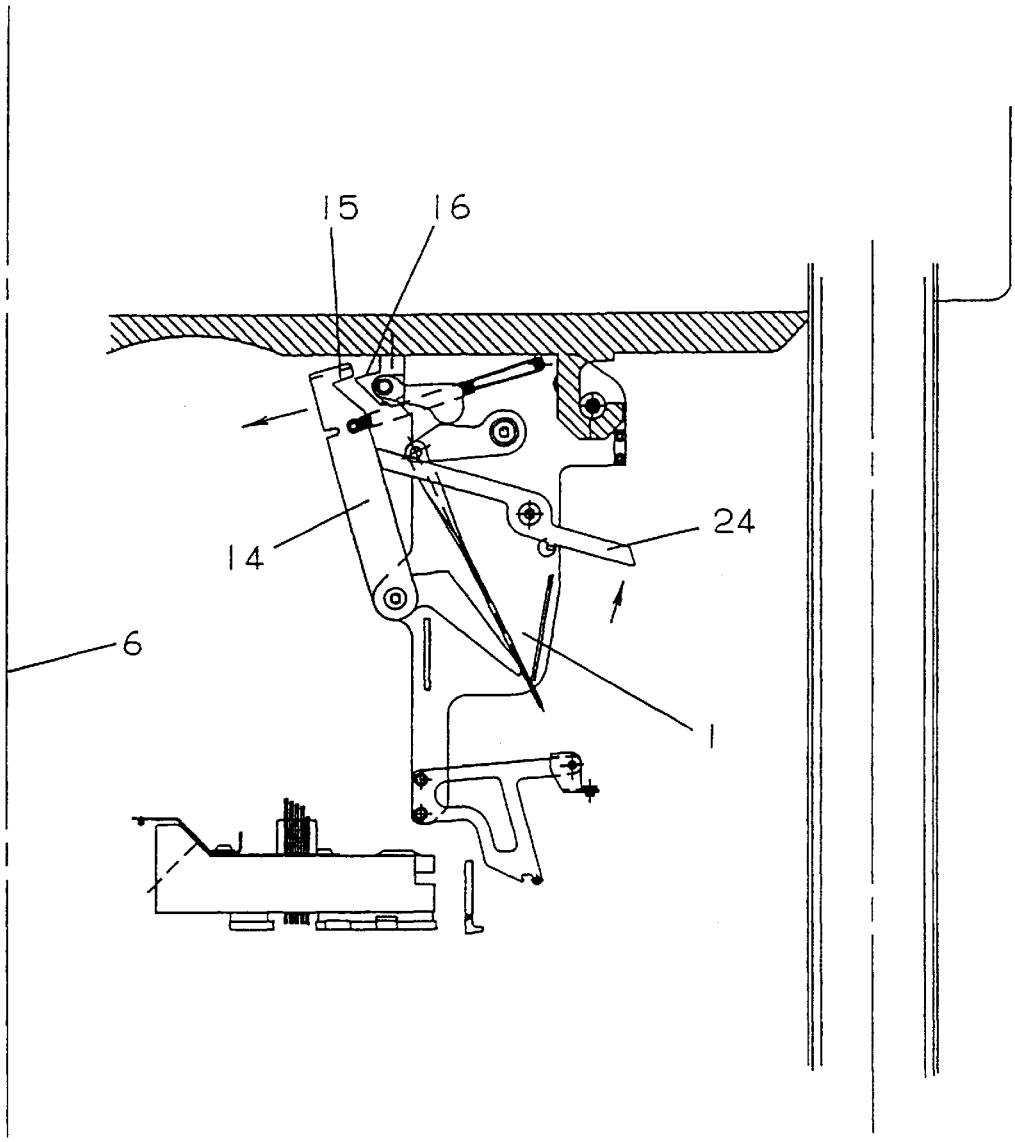
FIG. 4 shows the unlocking of the feeder.
Figure 5:
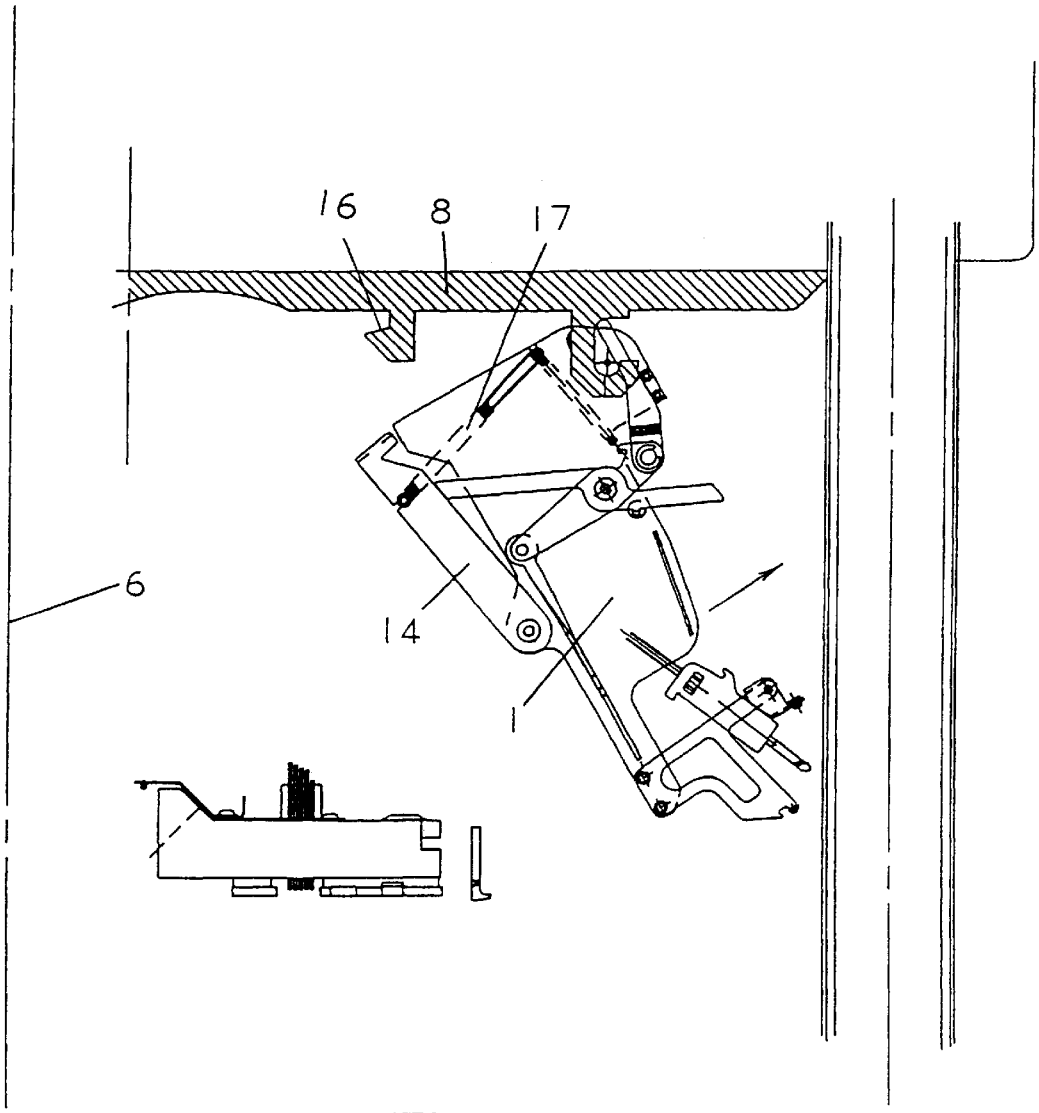
FIGS. 5 and 6 show the feeder in a turning position.
Figure 6:
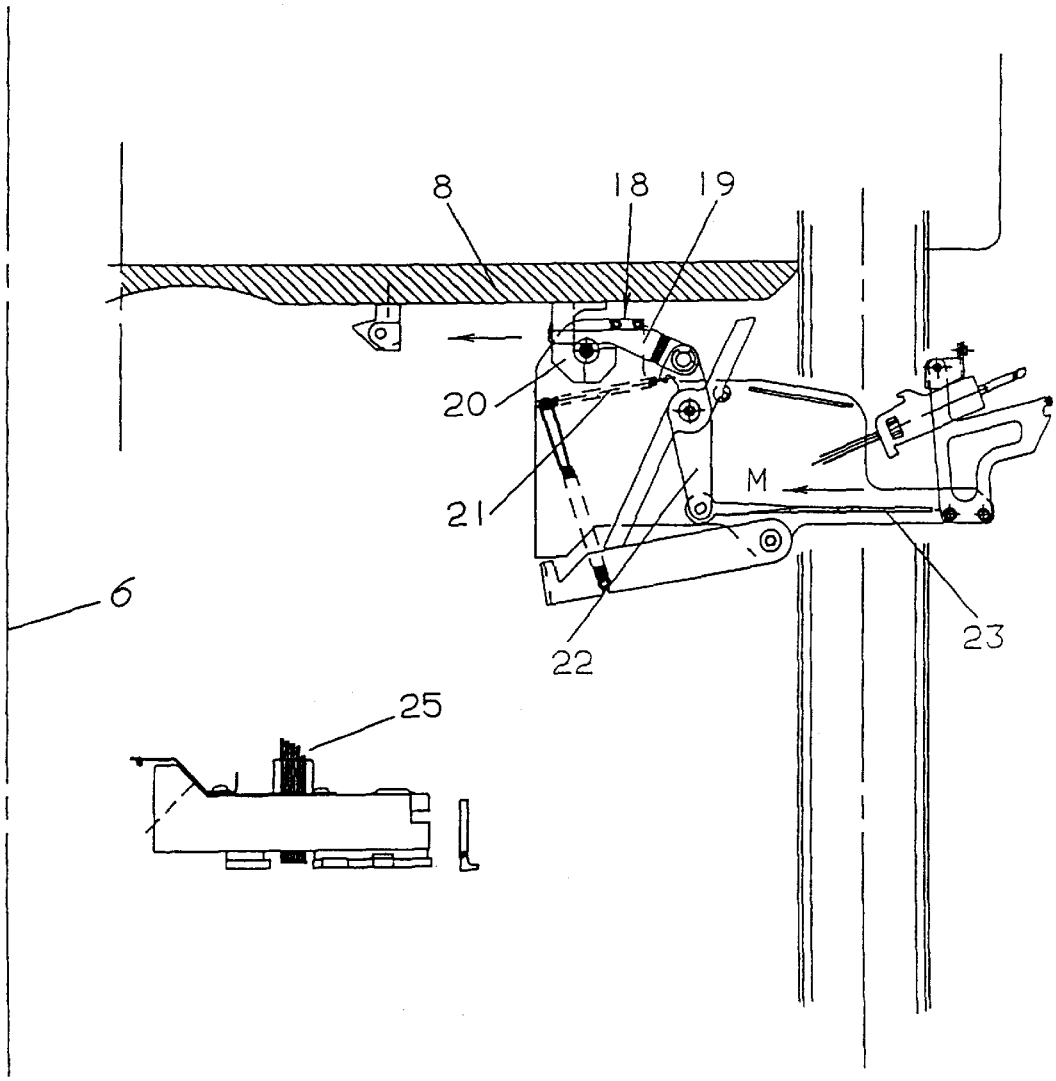

This joint (4) is made up of a joint shaft (5) that is tangent upon a circle that is perpendicular to shaft (6) of the machine, and it makes it possible to position the feeder (1) in the position shown in FIG. 3, which is suitable for the work of the feeder, or by means of turning the joint (4), it assumes an exterior position, as shown in FIGS. 4 to 6.

To support said shaft (5), a bearing (7) is placed so as to permit the above-mentioned turning movements as shown in FIGS. 3 to 6. In FIG. 3 we note a solution where the bearing (7) of joint (4) is integral with the fixed part (8) of the machine.

FIG. 7.1 shows an enlarged joint (4) of feeders (1) in FIG. 3; other examples of the joint (4) appear in FIGS. 7.2 and 7.3. All of them show the shafts (5) of the joint and their corresponding bearing (7). As can be seen, said bearing (7) has an open part (11) which makes it possible, by means of a movement perpendicular to shaft (5) of the joint, to release said shaft (5) from its bearing (7) so that one may extract the feeder from the machine.

To ensure that the feeder (1) cannot be extracted from the machine when it is in the working position shown in FIG. 3, a closing lever (9) and a closing counter-lever (10) are integrally arranged with feeder (1) and fixed support (8) so that, when the feeder (1) is in the mentioned position, it can be locked in position between the actions of said levers (9) and (10) and those of the shaft (5) and bearing (7).

On the other hand, when the feeder (1) is turned and when it is placed in the inclined position, as shown in FIG. 5, lever (9) and counter-lever (10) cease to be in contact, thus allowing the feeder (1) to slide.

In FIG. 8 we observe, in detail, one of the examples of joint (4), with the feeder (1), situated in the inclined position shown in FIG. 5, where lever (9) can be spaced away from counter-lever (10), which enables shaft (5) to follow the path of extraction (12), shown by broken lines, and consequently the feeder (1) can be extracted from the machine.

Naturally, the operation involved in inserting feeder (1) in the machine will follow the steps indicated, but in the inverse order.

As shown in FIGS. 7.1 to 7.3, the arrangement of shaft (5), bearing (7), lever (9), and counter-lever (10) makes it possible to adopt multiple solutions, although the samples shown do not have a restrictive character in this invention.

To prevent feeder (1) from turning, as shown in FIGS. 5 and 6, ensuring that it will stay in the working position in FIG. 3, a locking device (13) is arranged, situated toward the internal area of the machine (see FIG. 3).

The locking device (13) can consist, for example, of a slide or a locking lever (14) that has a first inclined plane

(15) for closing purposes, prepared so as to come into contact with a second inclined plane (16), conjugate with the first and situated integrally with the fixed part (8) of the machine. These surfaces (15) and (16) come into contact due to the action of a spring (17) that acts upon lever (14).

Due to the combined action of the above-mentioned mechanisms, the body of feeder (1) is pressed so that it is pushed toward its working position, indicated in FIG. 3, which means that the surfaces of levers (9) remain compressed between themselves against the counter-levers (10) and [that the surface] of the inclined plane (15) is pressed against (16) [sic].

It is obvious that the locking device (13) can adopt and may present various options without changing the object of the invention. As a compliment to this locking device (13), a release lever (24) is placed, according to FIG. 4, by means of which, and from the outside of the machine, the operator may exert pressure along the lines of the arrows indicated in FIG. 4, which causes lever (14) to turn, and, consequently, the inclined closing plane (15) ceases to be in contact with the inclined plane (16) which releases the feeder (1) so that it may be turned, as shown in FIGS. 5 and 6.

A second locking device (18) is shown in FIG. 6. Its purpose consists of locking the feeder body (1) in its out-of-action position, as shown in FIG. 6.

The example in FIG. 6 represents a locking device (18), consisting of a slide (19) controlled by lever (22), which is linked to a handle (23) by means of a joint.

Slide (19) can penetrate a slide bearing (20), made in piece (7), corresponding to the bearing of shaft (5). In this situation, the slide (19) locks and retains feeder (1) in the out-of-action position which is observed in FIG. 6, thus enabling the operators to access the interior part (25) of the machine.

By manually moving handle (23), as indicated in FIG. 6 by the arrow M, the slide (19) can be moved away from bearing (20), thus releasing the turn of the feeder (1) and making it impossible to lift the latter to the positions indicated in FIGS. 3 and 5.

Additionally, slide (19) can be activated directly or indirectly by a spring (21) that forces it to penetrate into bearing (20) the moment the latter is faced by slide (19) without the need for further manipulation.

According to the examples indicated, the object of this patent is to provide a system for the attachment of feeders, with a high degree of attachment security and, at the same time, to provide great ease in the extraction of the feeders from the machine, which can be achieved without the use of tools.

In addition, the device makes it possible to maintain the working position with the feeder locked and a position of the feeder outside the machine, which makes it possible to access the interior of the machine without the use of tools; likewise, there is no need to cut the threads of the feeder.

This is all of special importance for reducing the machine preparation time and for improving the ease of machine use.

What is claimed is:

1. A device for detachably and pivotably mounting feeders in circular machines for knitted fabrics, comprising:

a circular knitting machine having a central shaft having a longitudinal axis, said knitting machine having a fixed part;

a feeder having a body having an upper-and-outer part;

a support carried by one of said fixed part and said upper-and-outer part;

a pivot shaft having an axis perpendicular to the longitudinal axis of the central shaft carried by another of said fixed part and said upper-and-outer part, portions of said pivot shaft being detachably and pivotably carried in said support;

whereby said feeder can be pivoted about said axis of said pivot shaft from a first position wherein said feeder is oriented toward an interior of the machine, the first position being a working position suitable for delivery of threads to the machine, to a second non-working position wherein said feeder is oriented toward an exterior of the machine, such that in the second position the feeder is lifted outside a working area, thus making the interior of the machine accessible without having to remove the feeder from the machine or cutting the threads.

2. The device for detachably and pivotably mounting feeders in circular machines for knitted fabrics according to claim 1, wherein said support further comprises:

a bearing to support said pivot shaft said bearing and said pivot shaft having at least one relative degree of freedom corresponding to a pivot of said feeder relative.

3. The device for detachably and pivotably mounting feeders in circular machines for knitted fabrics according to claim 1, wherein said bearing further comprises: at least one open part having an opening through which opening said pivot shaft can be released from said bearing so that the feeder can be extracted from the machine.

4. The device for detachably and pivotably mounting feeders in circular machines for knitted fabrics according to claim 1, further comprising:

a lever and a counter-lever disposed between said feeder and said fixed part whereby when said feeder is in the first position an interference between said lever and said counter-lever prevents said feeder from being extracted from the machine, but when said feeder is in the second position a gap is formed between said lever and said counter-lever whereby said pivot shaft can be removed from said support so that said feeder can be extracted from the machine.

5. The device for detachably and pivotably mounting feeders in circular machines for knitted fabrics according to claim 1, further comprising a first lock for locking said feeder in the first position.

6. The device for detachably and pivotably mounting feeders in circular machines for knitted fabrics according to claim 5, wherein said first lock comprises:

a locking lever pivotally carried by said body, said locking lever having a jaw having an inclined plane a second jaw having an inclined plane carried by said fixed part;

a spring biasing said locking lever towards said body;

wherein said inclined plane of said jaw of said locking lever engages said inclined plane of said jaw carried by said fixed part in such a way that said locking lever biases the feeder towards the first position due to the action of said spring.

7. The device for detachably and pivotably mounting feeders in circular machines for knitted fabrics according to claim 1, further comprising a second lock for locking said feeder in the second position.

8. The device for detachably and pivotably mounting feeders in circular machines for knitted fabrics according to claim 7, wherein said second lock comprises:

a slide that works against a that cooperatively engages a support carried by said fixed part when said feeder is in said second position.

9. The device for detachably and pivotably mounting feeders in circular machines for knitted fabrics according to claim 5, further comprising a release for releasing said first lock.

10. The device for detachably and pivotably mounting feeders in circular machines for knitted fabrics according to claim 1, wherein said pivot shaft is integral with one of said body and said fixed part.

11. The device for detachably and pivotably mounting feeders in circular machines for knitted fabrics according to claim 7, wherein said second lock comprises:

a ratchet that cooperatively engages a support carried by said fixed part when said feeder is in said second position.

12. The device for detachably and pivotably mounting feeders in circular machines for knitted fabrics according to claim 7, further comprising a release for releasing said second lock.

* * * * *

UNITED STATES PATENT AND TRADEMARK OFFICE

CERTIFICATE OF CORRECTION

PATENT NO. : 6,237,372 B1
DATED : May 29, 2001
INVENTOR(S) : Antonio Puigventos

It is certified that error appears in the above-identified patent and that said Letters Patent is hereby corrected as shown below:

Claim 2,
Line 7, before ".", insert -- to the fixed part of the machine --

Claim 3,
Line 3, change "1" to -- 2 --

Claim 6,
Line 5, after "plane insert -- ; --

Claim 8,
Line 4, delete "that works against a"

Signed and Sealed this

Twentieth Day of November, 2001

*Attest:*

Nicholas P. Godici

*Attesting Officer*

NICHOLAS P. GODICI
*Acting Director of the United States Patent and Trademark Office*